US005284004A

United States Patent [19]

Metzler

[11] Patent Number: 5,284,004

[45] Date of Patent: Feb. 8, 1994

[54] INSERTION STATION FOR ENVELOPE-STUFFING APPARATUS OR FOR A SECTION THEREOF OF MAIL HANDLING APPARATUS

[75] Inventor: Kurt O. Metzler, Friedberg/Hessen, Fed. Rep. of Germany

[73] Assignee: Bell & Howell GmbH, Friedberg, Fed. Rep. of Germany

[21] Appl. No.: 969,279

[22] PCT Filed: Apr. 13, 1992

[86] PCT No.: PCT/EP92/00830

§ 371 Date: Jan. 22, 1993

§ 102(e) Date: Jan. 22, 1993

[87] PCT Pub. No.: WO92/20532

PCT Pub. Date: Nov. 26, 1992

[30] Foreign Application Priority Data

May 22, 1991 [DE] Fed. Rep. of Germany ..... 4116708

[51] Int. Cl.[5] ..... B65B 35/20; B65B 5/04

[52] U.S. Cl. ..... 53/569; 53/284.3; 53/252

[58] Field of Search ..... 53/569, 284.3, 381.5, 53/381.6, 381.7, 252; 270/58; 271/2, 84, 271

[56] References Cited

U.S. PATENT DOCUMENTS

| | | | |
|---|---|---|---|
| 4,205,506 | 6/1980 | Moens et al. | 53/284.3 X |
| 4,494,742 | 1/1985 | Gunther et al. . | |
| 4,720,960 | 1/1988 | Green | 53/284.3 X |
| 4,798,040 | 1/1989 | Haas et al. | 53/284.3 X |
| 4,922,689 | 5/1990 | Haas et al. | 53/284.3 X |
| 4,955,185 | 9/1990 | Haas et al. | 53/284.3 X |

*Primary Examiner*—Horace M. Culver

*Attorney, Agent, or Firm*—Millen, White, Zelano, & Branigan

[57] ABSTRACT

An insertion station for a mail-handling machine includes a driving lever 25 and a means for swivelling the driving lever 25 back-and-forth according to an operating cycle. Axle members 18, 19 have a cam 20 mounted therebetween and a spring 26 extends between the driving lever 25 and the cam. A base plate 1 includes grooves 2, 3, 4 and finger-roller guides 28 have front and rear ends mounted above the base plate. Insertion ramps 35, 36, 37 are located below the rear ends of the finger-roller guides; and, inserting arm means 8, 9, 10 and 14, 15, 16 have fingers 5, 6, 7 and finger rollers 27, 38, 39 attached thereto. The inserting arm means 8, 9, 10 and 14, 15, 16 are connected to the axles 18, 19; the fingers 5, 6 and 7 are mounted on the insertion arms which are adapted to slide the fingers 5, 6, and 7 forwardly in an input direction in the grooves 2, 3, 4 of the base plate 1; and, the finger rollers 27, 38, 39 are in engagement with the finger-roller guides 28 for movement backwardly and upwardly above the base plate under control of the finger-roller guides, wherein, upon reaching the rear end of the finger-roller guides, the finger rollers 27, 38, 39 fall onto the insertion ramps 35, 36, 37 for the gradual insertion of the input fingers into the corresponding grooves 2, 3, 4 of the base plate 1. Rotary tension-adjustment means are connected between the axles 18, 19 and the inserting arm means for reducing bounce of the inserting-arm means.

17 Claims, 2 Drawing Sheets

INSERTION STATION FOR ENVELOPE-STUFFING APPARATUS OR FOR A SECTION THEREOF OF MAIL HANDLING APPARATUS

BACKGROUND

This invention relates to an insertion station for envelope-stuffing apparatus or for envelop-stuffing apparatus sections of mail handling apparatus. Frequently-used insertion stations of the prior art comprise a driving lever which swivels back and forth, in accordance with an operating cycle, and vertically to the feeding direction of the material to be inserted into envelopes. An axle arrangement is mounted thereto and is spring-loaded, perpendicularly to a base plate and parallel to the driving lever—the axles having insertion arms with an adjustment block mounted to each of them. Fingers of the insertion arms slide forwardly in an input direction in grooves of the base plate and are cyclically moved backwardly and upwardly above the base plate in a movement controlled by a finger roller guide. After the fingers reach the rear end of the finger roller guide, they transition from the backward location to forward input movement while at least one of the input finger rollers falls onto a substantially wedge-shaped insertion ramp for a gradual insertion of the input finger into the corresponding groove of the base plate.

The insertion stations of the prior art are generally time-tested, but one particular problem arises due to continuous increases in the operational speeds of mail handling apparatus. That is, the finger roller mounted onto an insertion arm abruptly leaves a finger roller guide at the end of a return movement in a cycle during which the finger roller guide is lowered onto and raised above the base plate upon the return movement. Tension of spring devices between the axle arrangement and the driving lever then causes the entire insertion-arm group to snap downwardly in the direction of the base plate. This movement causes the fingers of the insertion arms to noisily hit the grooves of the base plate and possibly bounce back such that the ends of the fingers reach above the material to be enveloped, and thus cause malfunctions.

It is a further disadvantage of apparatus of the prior art that the slack or play between the axle arrangement and the axle-ends of the insertion arms becomes uncontrollably larger after a comparatively short operation period such that irregular operation of individual insertion arms must be expected. Attempts have been made in apparatus of the prior art to correct this by adjusting the spring tension between the axle arrangement and the back-and-forth swivelling driving lever. These attempts, however, have not been satisfactory because of increases in the above-mentioned problems of noisy snapping movements of the insertion arms at the end of a return movement before the insertion movement.

It is an object of this invention to provide an insertion station of the type described above wherein increases in operational speed nevertheless allow reliable functioning, a longer operation span between required adjustments of assemblies, lower noise levels and lower maintenance.

SUMMARY

The foregoing and other objectives of this invention are achieved by including a tension-adjustment mechanism between an above-described axle arrangement and the insertion arms so that the objectional insertion-arm bounce is substantially reduced.

BRIEF DESCRIPTION OF THE DRAWINGS

The foregoing and other objects, features, and advantages of the invention will be apparent from the following more specific description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 1:
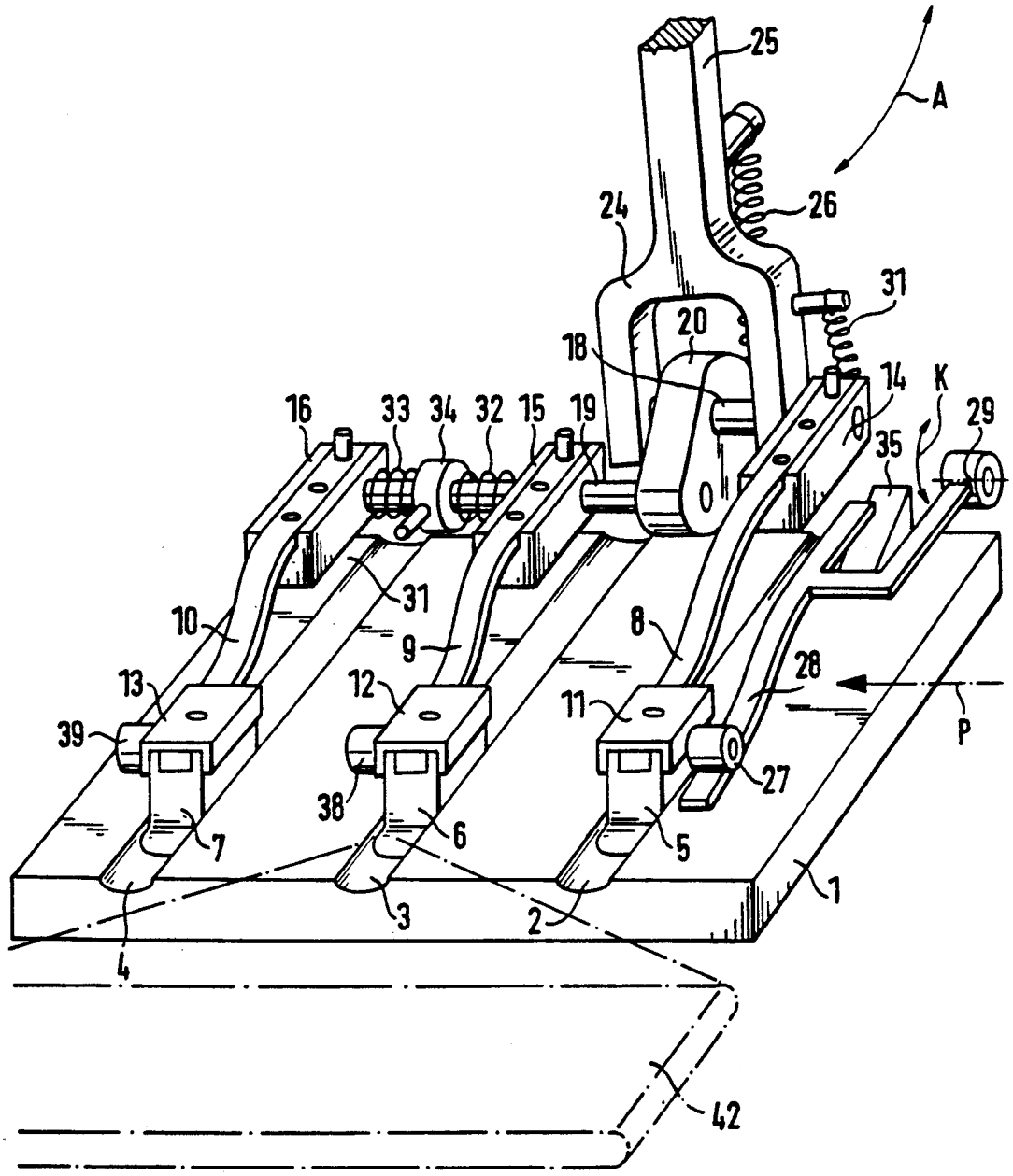
FIG. 1 is an isometric, schematic view of an insertion station according to this invention.

The insertion station as depicted in FIG. 1 is part of an envelope-stuffing apparatus section which, for example, may be the last station in a mail-handling conveyor chain schematically indicated by a dot-dash arrow P. The mail-handling station of FIG. 1 may have handling stations arranged ahead, or in front, for collecting form-sheet stacks and/or for conveying form sheets or form sheet stacks. Thus, in accordance with an operation cycle, sheet stacks introduced by the conveyor chain from previous stations, may be inserted into the insertion station of FIG. 1 as material to be enveloped by the structure according to FIG. 1.

The insertion station has a base plate 1 with grooves 2, 3, 4 arranged laterally to the feeding path of the conveyor chain P. These grooves interact with insertion fingers 5, 6, 7, made from flexible, hardplastic material, in a manner described in the following.

As depicted in FIG. 1, block-shaped portions of insertion fingers 5, 6, 7 have slots, or notches, parallel to the grooves 2, 3, 4 into which the front ends of insertion arms 8, 9, 10 are fitted for fastening to the insertion fingers 5, 6, 7 by means of shaped plates 11, 12, 13. The rear portions of the insertion arms 8, 9, 10 have bearing blocks 14, 15, 16 holding the rear portions of the insertion arms in rear slots as shown. The rear ends of the insertion arms 8, 9, 10 are fastened to the rear slots by any suitable means such as the screws shown in FIG. 2.

Figure 2:
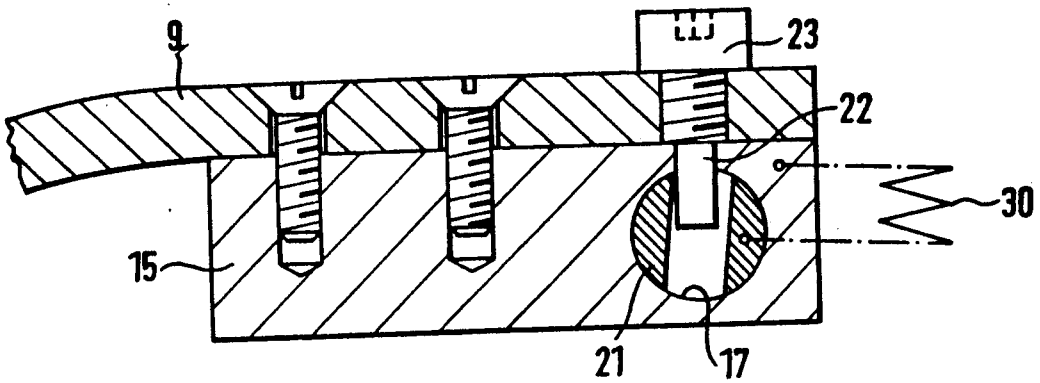
FIG. 2 is a cross-sectional, partially-schematic, partial view of a connection between the rear end of an insertion arm and an axle arrangement for a rotary slack or tension-adjustment mechanism.

The bearing blocks 14, 15, 16 have bearing bore holes 17 (FIG. 2). An axle 18 extends through the bearing bore hole 17 of the bearing block 14; and, an axle 19 extends through the bearing bore hole 17 of the bearing blocks 15 and 16. The axles 18 and 19 are arranged parallel to the direction of the conveyor chain P, laterally to the direction of the grooves 2, 3, 4 and parallel to one another.

A cam or link 20 is fixedly coupled to and positioned between the axles 18 and 19. In working embodiments of the insertion station of this invention, the cam 20 has certain adjustment features and a certain shape, but those matters are not significant here and will not be further discussed. The axles 18 and 19 and the fixedly-coupled cam 20 make up an axle arrangement onto which the insertion arms 8, 9, 10 are mounted with limited adjustment for rotational slack.

This rotational slack adjustment is, for example, as known from prior art arranged such that the axles 18 and 19 respectively have a bore hole 21 in the area inside the bearing blocks 14, 15, 16. A screw 23 is screwed into a partially-threaded hole through the respective insertion arm 9 and bearing block 15 and a tapered or stepped pin-shaped end 22 extends into the bore hole 21. In this respect, as shown in FIG. 2, the end 22 has a smaller diameter than the bore hole 21.

The thusly arranged rotational tensioning or slack adjustment between the axle 19 and the insertion arm is for ensuring even, smooth engagement, or contact, of the insertion fingers 5, 6, 7, with the matching grooves 2, 3, 4 of the base plate , notwithstanding small adjustment errors, or misalignments, between the direction of the base plate 1 and the axle arrangements.

The end portions of the axle 18 extending from both sides of the cam 20 extend into legs 24 of the fork-shaped driving lever 25, which is cyclicly swivelled back and forth in the direction of an arrow A laterally to the direction (P) of the conveyor chain as determined by the machine cycle of the insertion machine. In this manner, the insertion arms 8, 9, 10 are moved along, in the direction corresponding to the grooves 2, 3, 4 of the base plate 1.

During the above-described swivel movement of the driving lever 25, the insertion arms 8, 9, 10 are also continuously biased, or spring-loaded, with regard to the corresponding grooves 2, 3, 4 by a spring 26 arranged between the driving lever 25 and the cam 20 and, thereby, also between the driving lever 2 and the axle arrangement 18, 19.

For moving the material to be enveloped onto the base plate 1 and underneath the insertion arms during their return movement, a roll-shaped finger roller 27 is mounted to a side of the insertion finger 5. The finger roller 27 cooperates with a strip-shaped finger-roller guide 28 such that the finger-roller guide 28 is moved upwardly and downwardly by conventional means about an axis 29 which is parallel to the feeding path (P) in the direction of the arrow K in accordance with the operating cycle of the insertion machine. When the insertion arms 8, 9, 10 have executed an insertion movement, the finger roller 27, during the return movement, rolls onto a front portion of the finger-roller guide 28 which is substantially touching the base plate 1. The finger-roller guide 28 is then swivelled, or moved, upwardly about its axis 29, thereby lifting up all of the insertion arms 8, 9, 10 linked, or coupled, by means of the axle arrangement above the base plate 1.

According to an important feature of the insertion station of this invention, the individual torsional or rotational slack-adjustment assemblies between (1) the axles 18 and 19 and (2) the bearing blocks 14, 15, 16 are individually spring-loaded, or biased, by schematically-illustrated spring devices 30 (FIG. 2) such that the pin-shaped ends 22 of the screws 23 fasten off-center to the associated hole 21. In this manner, as shown in FIG. 2, the ends 22 abut the side of the hole 21 that is closest to the insertion fingers 5, 6, 7.

The spring devices 30 can be comprised of a helical spring 31 (FIG. 1) extending between spring bearings on the bearing block 14 and a forked leg 24 of the driving lever 25 or by helical springs 32 and 33 arranged about the axle 19 and extending between (1) the bearing blocks 15 and 16 and (2) an adjustment ring 34 which is fastened such as by a radial bore and screw arrangement to the axle 19 between the bearing blocks 15 and 16. The biasing means, or springs, 30 effect automatic activation of the rotation-slack-adjustment assemblies between the axle arrangement and the insertion arms 8, 9, 10 such that the insertion arms 8, 9, 10 do not snap, or bounce, even at maximum rotary slack along the axes of the axle arrangement.

Wedge-shaped insertion ramps, or finger-roller guide ramps 35, 36, 37 are arranged adjacent the rear portion of the grooves 2, 3, 4, wherein the wedge-shaped insertion ramp 35 interacts with the finger roller 27 of the insertion arm 8, while the further wedge-shaped insertion ramps 36 and 37 interact with roll-shaped finger rollers 38 and 39, which are located adjacent the block-shaped insertion fingers 6 and 7. At the end of a return movement of the driving lever 25 the finger roller 27 leaves the finger roller guide 28 and the spring 26 allows the insertion arms 8, 9, 10 to swivel downwardly while the cam 20 is pivoted. The insertion fingers 5, 6, 7, however, do not fall immediately into the corresponding grooves 2, 3, 4 of the base plate 1. Instead their finger rollers 27, 38, 39 first reach the wedge-shaped insertion ramps 35, 36, 37 so that, during the following insertion movement, the insertion fingers 5, 6, 7 enter the grooves 2, 3, 4 gradually and gently, thus avoiding loud noise and the development of bouncing that may lead to malfunctions.

Figure 3:
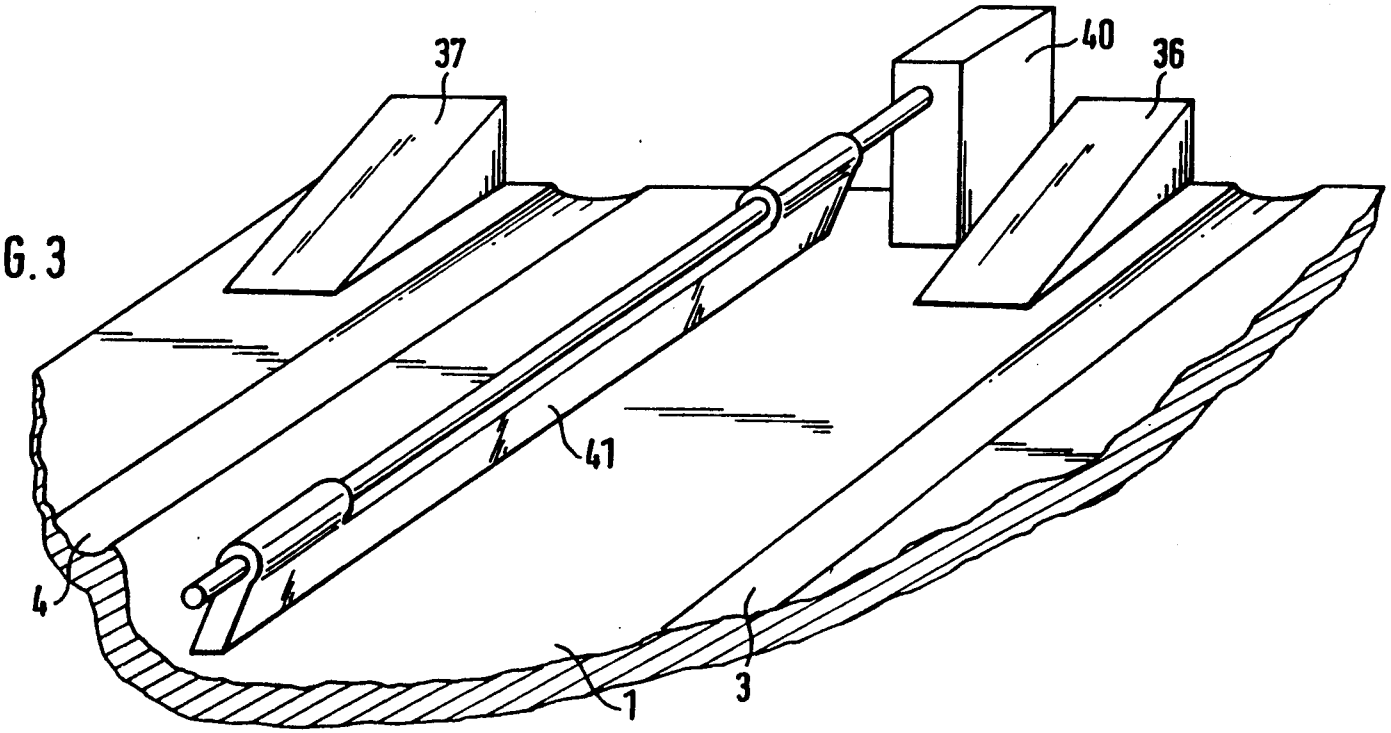
FIG. 3 is an isometric, sectional, schematic view of the rear portion of the base plate of the insertion station as in FIG. 1 with an additional device for holding down material to be stuffed into envelopes.

FIG. 3 shows a swivelling strip-shaped brush 41 which may be a metal strip with a bevelled edge facing downwardly, for holding down the material to be stuffed into envelopes. The brush or strip 41 hangs from a rod mounted at one end to a block 40, while the other end is suspended in a cantilever manner and arranged at the rear end of the base plate 1 between the grooves 2, 3, 4. In this manner, material that is to be inserted by the insertion fingers 5, 6, 7 passes underneath the swivelling brush 41 before being inserted into an envelope 42 shown in FIG. 1 by dot-dash lines.

Prior art devices for holding down the material to be stuffed into envelopes have been plate-shaped and spring-loaded. In contrast, the swivelling brush or strip 41 of the instant invention has the shape of a metal strip with a bevelled edge facing downwardly; and, this improves accessibility of the insertion station in a relatively uncomplicated, or simplified arrangement.

While the invention has been specifically shown and described with reference to preferred embodiments, it will be understood by those skilled in the art that various changes in form and detail may be made therein without departing from the spirit and scope of the invention.

I claim:

1. An insertion station for envelope-stuffing sections of mail-handling apparatus which operates in accordance with an operating cycle to insert material into envelopes, said insertion station comprising:

a driving lever;

means for swivelling said driving lever according to said operating cycle, said swivelling being back and forth and vertically to a feeding direction of said material to be inserted into said envelopes;

at least one axle member;

a first member mounted to said at least one axle member;

spring means extending between said driving lever, and said first member;

a base plate having grooves therein;

finger-roller guides having front and rear ends and being mounted above said base plate;

insertion ramps located below said rear ends o said finger-roller guides;

inserting arm means having insertion arms having insertion fingers and finger rollers attached thereto;

said inserting arm means being connected to said at least one axial member; said fingers being mounted on said insertion arms which are adapted to slide said fingers forwardly in an input direction in said grooves of said base plate; and, said finger rollers being in engagement with said finger-roller guides for movement backwardly and upwardly above said base plate under control of said finger-roller guides, wherein, upon reaching said rear end of said finger-roller guides, said finger rollers fall onto said insertion ramps for the gradual insertion of said insertion fingers into the corresponding grooves of said base plate; and, rotary tension adjustment means connected between said at least one axle and said inserting arm means for reducing bounce of said inserting-arm means.

2. An insertion station as in claim 1 including spring means for biasing said insertion arms and thereby said insertion fingers into contact with said grooves of said base plate.

3. The insertion station of claim 2 wherein said spring means is comprised of at least one helical spring acting on said at least one axle member.

4. The insertion station of claim 2 including spring bearing means connected to said helical springs for adjusting the bias of said fingers toward said grooves of said base plate.

5. The insertion station of claim 2 wherein said spring means is connected to said driving lever.

6. The insertion station of claim 1 wherein said insertion fingers are molded from a flexible, hard-plastic material.

7. The insertion of claim 2, wherein said finger rollers are mounted adjacent said insertion fingers.

8. The insertion station of claim 1, wherein said insertion fingers are molded from a flexible, hard-plastic material.

9. The insertion station of claim 1, wherein said first member is a cam.

10. The insertion station of claim 1, wherein said finger rollers are mounted adjacent said insertion fingers.

11. The insertion station of claim 1, including a cantilevered holding means that is elongate about an axis thereof and extending above said base plate between said grooves and substantially parallel thereto for holding down material that is to be stuffed into said envelopes.

12. The insertion station of claim 11, wherein said holding means is a brush.

13. The insertion station of claim 12, wherein said brush is adapted to swivel about said elongate axis.

14. The insertion station of claim 1, wherein said inserting arm means includes bearing block means journaled about said at least one axle;

a bore hole in said at least one axle, said bore hole having a leading edge and a trailing edge thereof;

an elongate fastening means extending through said inserting arm means and into said bore hole so that said fastening means engages said leading edge of said bore hole.

15. The insertion station of claim 14, wherein said tension-adjustment means is connected between said at least one axle and said bearing block means.

16. The insertion station of claim 15, including adjusting-ring means connected between said at least one axle member and said bearing block means.

17. The insertion station of claim 16, including adjusting-ring means connected between said at least one axle member and said inserting-arm means.

* * * * *